US010782631B2

(12) United States Patent
Onodera

(10) Patent No.: US 10,782,631 B2
(45) Date of Patent: Sep. 22, 2020

(54) IMAGE FORMING APPARATUS

(71) Applicant: KONICA MINOLTA, INC., Chiyoda-ku, Tokyo (JP)

(72) Inventor: Masahiro Onodera, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/718,898

(22) Filed: Dec. 18, 2019

(65) Prior Publication Data

US 2020/0241442 A1 Jul. 30, 2020

(30) Foreign Application Priority Data

Jan. 28, 2019 (JP) ..... 2019-012400

(51) Int. Cl.
*G03G 15/08* (2006.01)
*G03G 15/20* (2006.01)

(52) U.S. Cl.
CPC ..... *G03G 15/0849* (2013.01); *G03G 15/2064* (2013.01); *G03G 2215/2045* (2013.01)

(58) Field of Classification Search
CPC ..... G03G 15/0849; G03G 15/2064; G03G 2215/2045
See application file for complete search history.

(56) References Cited

U.S. PATENT DOCUMENTS 5,177,503 A 1/1993 Kubelik
8,995,865 B2 3/2015 Tamaki et al.
9,207,603 B2 12/2015 Murakami et al.
2013/0089349 A1* 4/2013 Kemmochi ..... G03G 15/2064 399/67
2014/0086608 A1 3/2014 Murakami et al.
2014/0363185 A1* 12/2014 Tamada ..... G03G 15/2028 399/68

FOREIGN PATENT DOCUMENTS

JP 2014081610 A 5/2014

OTHER PUBLICATIONS

Extended European Search Report (EESR) dated Jun. 30, 2020 issued in European Patent Application No. 19213916.0.

* cited by examiner

*Primary Examiner* — Sandra Brase
(74) *Attorney, Agent, or Firm* — Holtz, Holtz & Volek PC

(57) ABSTRACT

Provided is an image forming apparatus capable of preventing or suppressing occurrence of density unevenness even when a shearing force is applied between an image face on paper and a fixing belt. The image forming apparatus includes an image former, a fixer, and a controller. The image former forms a toner image constituted by a plurality of dots each containing a toner on paper. The fixer includes a fixing member moving at a first velocity and a pressure member forming a fixing nip portion with the fixing member and moving at a second velocity, and fixes the toner image on the paper at the fixing nip portion. When the first velocity and the second velocity at the fixing nip portion are different, the controller determines a toner amount to be attached to paper so as to make a toner amount distribution different in each of the dots before fixing.

10 Claims, 10 Drawing Sheets

| (A) | (B) | (C) | (D) |
|---|---|---|---|
| Unfixed | No shearing force after fixing (when assist applied) | Small shearing force after fixing (when nomal fixing without asist or break ) | Large shearing force after fixing (when break or over-assist applied) |
| Shape of a toner particle 6[μm] 6[μm] | Shape of a toner particle 15[μm] 15[μm] | Shape of a toner particle 19[μm] 15[μm] | Shape of a toner particle 26[μm] 15[μm] |

Direction of shearing force

IMAGE FORMING APPARATUS

CROSS-REFERENCE TO RELATED APPLICATION

The entire disclosure of Japanese Patent Application No. 2019-012400, filed on Jan. 28, 2019, is incorporated herein by reference in its entirety.

BACKGROUND

1. Technological Field

The present invention relates to an image forming apparatus.

2. Description of the Related Art

There is a demand for a fixing device that can stably fix a high-quality image on paper. In an electrophotographic image forming apparatus, paper on which a toner image has been formed by an image forming unit is caused to pass through a fixing nip portion of a fixing device to be heated and pressurized, thereby fixing the toner image on the paper. The fixing nip portion is formed, for example, between a fixing belt, disposed around a heating roller and a fixing roller, and a pressure roller in a configuration having the fixing belt, and is formed between the fixing roller and the pressure roller in a configuration having no fixing belt In relation to such a configuration, JP 2014-81610 A discloses a technique that provides a velocity difference between a surface of a pressure roller and a surface of a fixing belt to generate a shearing force between an image face on paper and the fixing belt, thereby preventing a phenomenon (gloss memory) in which the influence of a previous fixing process appears gloss unevenness.

SUMMARY

However, the image quality sometimes deteriorate when density unevenness of an image occurs although the shearing force applied between the image face on the paper and the fixing belt is advantageous in terms of controlling the glossiness.

The present invention has been made in view of the above circumstances, and an object thereof is to provide an image forming apparatus capable of preventing or suppressing the occurrence of density unevenness even when a shearing force is applied between an image face on paper and a fixing belt.

To achieve at least one of the above-mentioned objects, according to an aspect of the present invention, an image forming apparatus reflecting one aspect of the present invention comprises: an image former that forms a toner image constituted by a plurality of dots each containing a toner on a sheet; a fixer that includes a fixing member moving at a first velocity and a pressure member forming a fixing nip portion with the fixing member and moving at a second velocity, and fixes the toner image on the sheet at the fixing nip portion; and a controller that determines a toner amount such that a toner amount distribution is different in each of the dots before fixing when the first velocity and the second velocity at the fixing nip portion are different.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
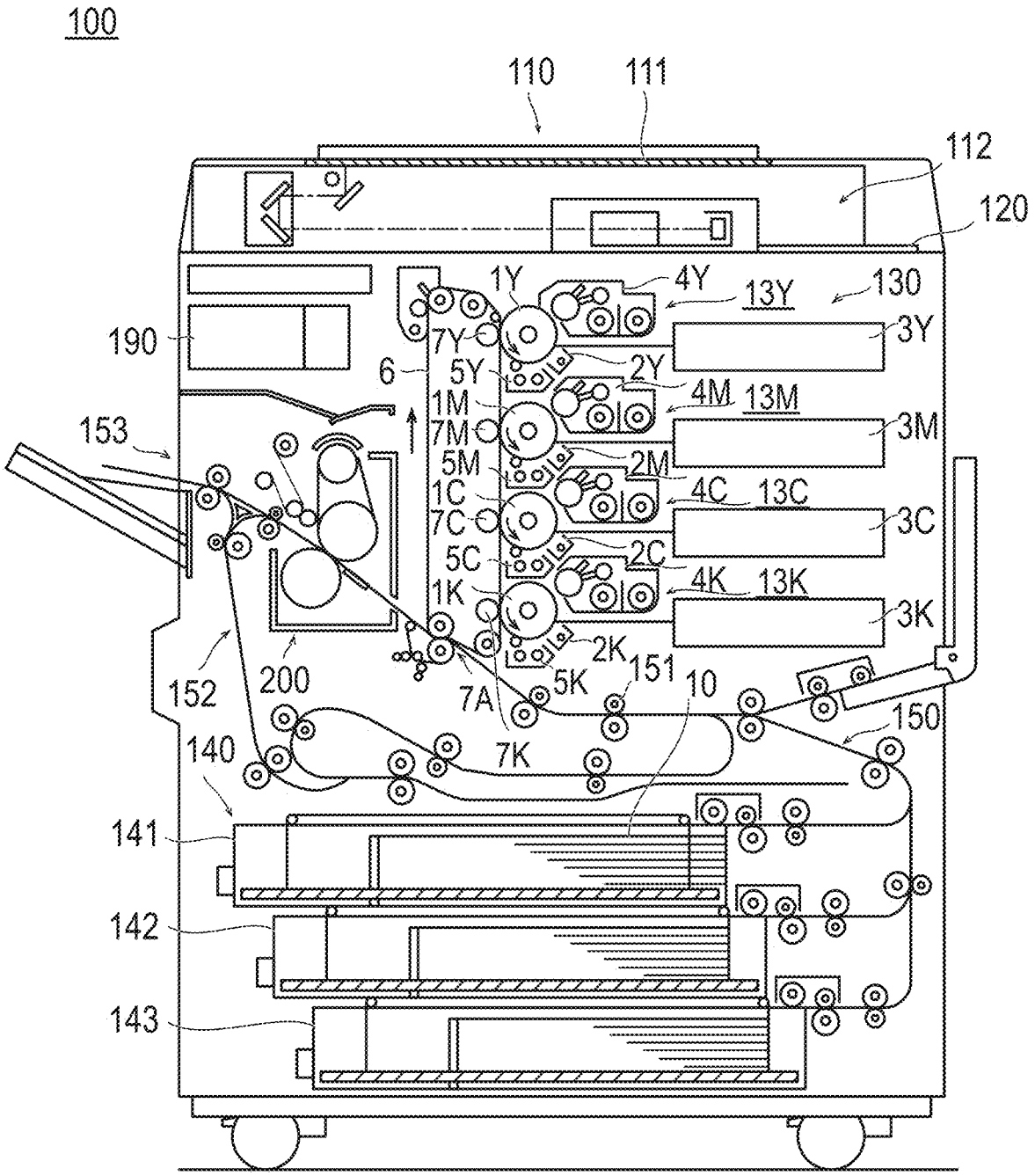
FIG. 1 is a schematic cross-sectional view illustrating a configuration of an image forming apparatus according to one embodiment.

Hereinafter, one or more embodiments of the present invention will be described with reference to the drawings. However, the scope of the invention is not limited to the disclosed embodiments. The same elements will be denoted by the same reference signs in the description of the drawings, and redundant descriptions thereof will be omitted. In addition, dimensional ratios in the drawings are exaggerated for convenience of the description, and are different from the actual ratios in some cases.

One Embodiment

<Image Forming Apparatus 100>

Figure 2:
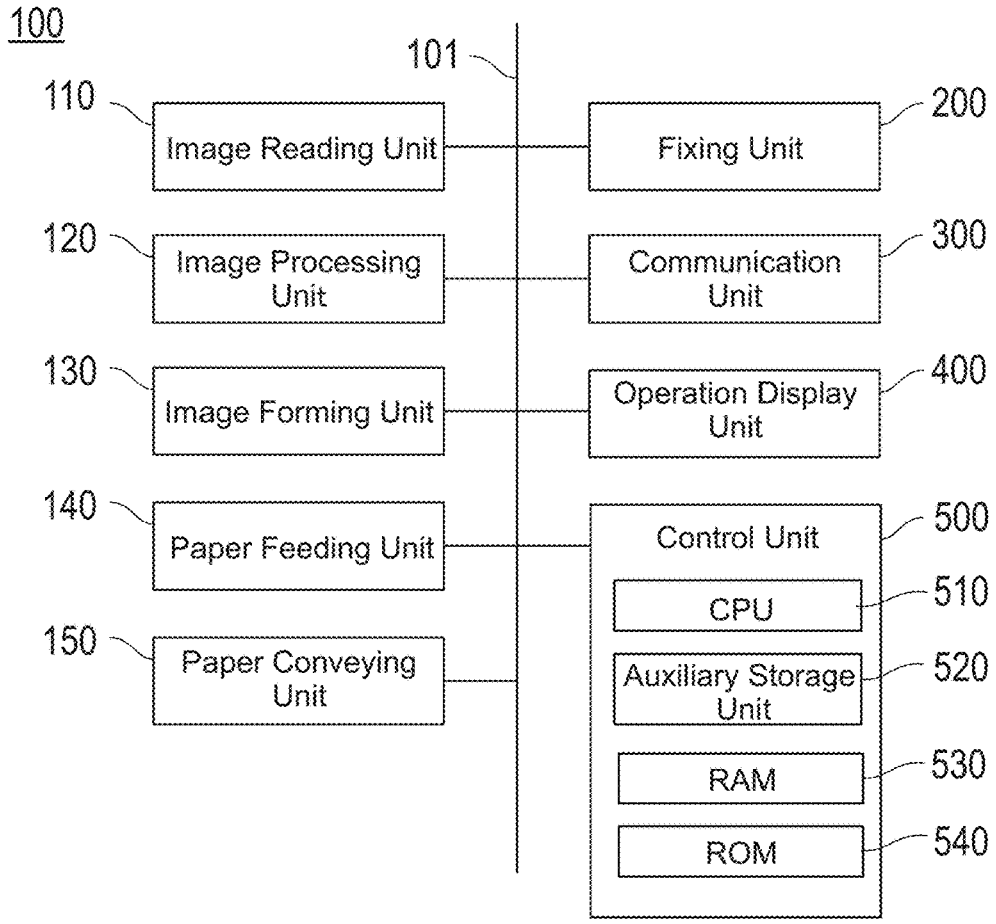
FIG. 2 is a schematic block diagram illustrating the configuration of the image forming apparatus illustrated in FIG. 1.

FIG. 1 is a schematic cross-sectional view illustrating a configuration of an image forming apparatus 100 according to one embodiment, and FIG. 2 is a schematic block diagram illustrating the configuration of the image forming apparatus 100.

The image forming apparatus 100 is called a tandem color image forming apparatus, reads an image from an original, and forms (prints) the read image on a sheet (for example, paper). Note that examples of the sheet can include one made of resin, one whose surface is coated with resin, and the like in addition to the paper. Hereinafter, a case where the paper is used as the sheet will be exemplified. In addition, the image forming apparatus 100 receives a print job including print data and print setting information in a PDL (Page Description Language) format from an external client terminal via a network, and forms an image on the paper based on the print job. The client terminal can be, for example, a personal computer, a tablet terminal, a smartphone, or the like.

As illustrated in FIG. 2, the image forming apparatus 100 includes an image reading unit 110, an image processing unit 120, an image forming unit (image former) 130, a paper feeding unit 140, a paper conveying unit 150, a fixing unit (fixer) 200, a communication unit 300, an operation display unit 400, and a control unit (controller) 500. These components are connected to each other via an internal bus 101 so as to be capable of communicating with each other.

The image reading unit 110 reads an original and outputs an image information signal. The original placed on an original table 111 is scanned and exposed by an optical system of a scanning exposure device of an image reading device 112 and read by a line image sensor. The photoelectrically converted image information signal is subjected to analog processing, A/D conversion, shading correction, image compression processing, and the like in the image processing unit 120, and then, is input to optical writing units 3Y, 3M, 3C, and 3K (to be described later) of the image forming unit 130 as print image data.

The image forming unit 130 forms an image (toner image) on the paper based on the print image data using a known image creation process such as an electrophotographic scheme including charging, exposing, developing, and transferring steps. The image forming unit 130 includes four sets of a subunit 13Y, a subunit 13M, a subunit 13C, and a subunit 13K that form yellow (Y), magenta (M), cyan (C), and black (K) images, respectively.

The subunit 13Y includes a photosensitive drum 1Y and a charging unit 2Y, an optical writing unit 3Y, a developing device 4Y, and a drum cleaner 5Y arranged around the photosensitive drum 1Y.

Similarly, the subunit 13M includes a photosensitive drum 1M and a charging unit 2M, an optical writing unit 3M, a developing device 4M, and a drum cleaner 5M arranged around the photosensitive drum 1M; the subunit 13C includes a photosensitive drum 1C and a charging unit 2C, an optical writing unit 3C, a developing device 4C, and a drum cleaner 5C arranged around the photosensitive drum 1C; and the subunit 13K includes a photosensitive drum 1K and a charging unit 2K, an optical writing unit 3K, a developing device 4K, and a drum cleaner 5K arranged around the photosensitive drum 1K.

The respective photosensitive drums 1Y, 1M, 1C, and 1K, the respective charging units 2Y, 2M, 2C, and 2K, the respective optical writing units 3Y, 3M, 3C, and 3K, and the respective developing devices 4Y, 4M, 4C, and 4K, and the respective drum cleaners 5Y, 5M, 5C, and 5K in the subunits 13Y, 13M, 13C, and 13K have the same content, respectively. Hereinafter, reference signs Y, M, C, and K will not be used unless particularly distinguished.

The image forming unit 130 writes the print image data on the photosensitive drum 1 with a laser provided in the optical writing unit 3, and forms a latent image based on the print image data on the photosensitive drum 1. Then, the latent image is developed by the developing device 4 to form a toner image, which is a visible image, on the photosensitive drum 1.

The yellow (Y), magenta (M), cyan (C), and black (K) images are formed, respectively, on the photosensitive drums 1Y, 1M, 1C, and 1K of the subunits 13Y, 13M, 13C, and 13K.

An intermediate transfer belt 6 is wound around a plurality of rollers to be supported so as to be capable of travel. The respective color toner images formed by the subunits 13Y, 13M, 13C, and 13K are sequentially transferred by primary transfer units 7Y, 7M, 7C, and 7K onto the traveling intermediate transfer belt 6, thereby forming a color image in which Y (yellow), M (magenta), C (cyan), and K (black) color layers are superimposed on each other.

The paper feeding unit 140 supplies paper as a recording material to the image forming unit 130. The paper feeding unit 140 includes an upper tray 141, a middle tray 142, and a lower tray 143, and the respective trays accommodate paper of different sizes, for example, A4 size, A3 size, and the like.

The paper conveying unit 150 conveys paper. The paper supplied from the upper tray 141, the middle tray 142, or the lower tray 143 is conveyed to a secondary transfer unit 7A via a resist roller 151, and the color image on the intermediate transfer belt 6 is transferred onto the paper.

In addition, the paper conveying unit 150 includes a paper reversing unit 152 so that it is possible to guide the paper that has been subjected to fixing to the paper reversing unit 152, to reverse the front and back and discharge the reversed paper or to form an image on both sides of the paper.

The fixing unit 200 fixes the color toner image formed on the paper by the image forming unit 130 onto the paper at a fixing nip portion. The paper on which the color image has been fixed is discharged to the outside of the image forming apparatus 100 through a paper discharge unit 153. Details of the fixing unit 200 will be described later.

The communication unit 300 is connected to a client terminal such as a personal computer via a network and transmits and receives data such as a print job.

The operation display unit 400 includes an input unit and an output unit. The input unit includes, for example, a keyboard and a touch panel, and is used by a user to perform various instructions (inputs) such as character input, various settings, and print instructions. In addition, the output unit includes a display, and is used to present a device configuration, an execution status of the print job, an occurrence status of an abnormality (jam) during paper conveyance, and the like to the user.

The control unit 500 controls the image reading unit 110, the image processing unit 120, the image forming unit 130, the paper feeding unit 140, the paper conveying unit 150, the fixing unit 200, the communication unit 300, and the operation display unit 400. The control unit 500 includes a CPU 510, an auxiliary storage unit 520, a RAM 530, and a ROM 540.

The CPU 510 executes a control program for the image forming apparatus. The control program is stored in the auxiliary storage unit 520 and loaded into the RAM 530 when executed by the CPU 510. The auxiliary storage unit 520 includes a large-capacity storage device, for example, a hard disk drive, a flash memory, and the like. The RAM 530 stores a calculation result or the like accompanying the execution of the CPU 510. The ROM 540 stores various parameters, various programs, and the like. The CPU 510 executes the control program and to realize various functions.

<Fixing Unit 200>

Figure 3:
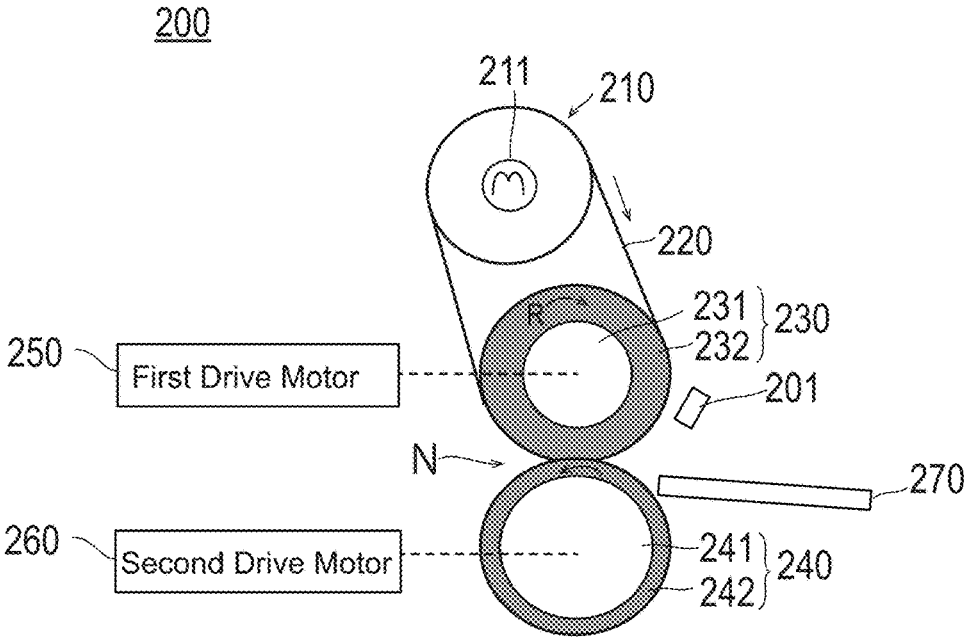
FIG. 3 is a schematic view illustrating the main configuration of a fixing unit illustrated in FIG. 1.

Next, a specific configuration of the fixing unit 200 will be described with reference to FIG. 3. FIG. 3 is a schematic view illustrating the main configuration of the fixing unit 200 illustrated in FIG. 1.

The fixing unit 200 includes a non-contact temperature sensor 201, a heating roller 210, a fixing belt 220, a fixing roller 230, a pressure roller 240, a first drive motor 250, a second drive motor 260, and an entry guide 270.

The heating roller 210 is, for example, a cylindrical metal core made of metal such as aluminum or a cylindrical metal core whose outer peripheral surface is coated with a fluorine resin or the like, and an outer diameter thereof is, for example, about 50 to 60 [mm]. The heating roller 210 includes a heater (for example, a halogen heater) 211 as a heating unit that heats the fixing belt 220.

The fixing belt 220 is obtained by, for example, coating an outer peripheral surface of a polyimide (PI) substrate having a thickness of 70 [μm] with an elastic layer, and further coating a surface layer with a heat-resistant resin. As the elastic layer, for example, heat-resistant silicone rubber (hardness JIS-A30 [°]) having a thickness of 200 [μm] can be used. As the heat-resistant resin, for example, a PFA (perfluoroalkoxy) tube having a thickness of 50 [μm] can be used. The fixing belt 220 is an endless belt, and is stretched between the heating roller 210 and the fixing roller 230 with a predetermined belt tension (for example, 250 [N]). An outer diameter of the fixing belt 220 is, for example, 120 [mm].

The fixing belt 220 comes into contact with paper on which a toner image has been formed and heats the paper at a fixing temperature. Here, the fixing temperature is a temperature (for example, 160 to 200 [° C.]) at which it is possible to supply the amount of heat necessary for melting a toner on the paper, and varies depending on a type of paper or the like on which an image is to be formed. Note that a surface temperature of the fixing belt 220 is detected by the non-contact temperature sensor 201, and the heating of the heater 211 is controlled by the control unit 500 to be maintained at a predetermined set temperature.

The fixing roller 230 functions as a fixing member, and includes, from the inside, a metal core 231 made of cylindrical metal, an elastic layer 232 made of a material such as silicone rubber or foamed silicone rubber and formed on the surface of the metal core 231, and a releasing layer (not illustrated) such as a fluororesin. An outer diameter of the fixing roller 230 is, for example, about 65 to 75 [mm], and preferably about 70 [mm]. A thickness of the elastic layer 232 may be, for example, about 15 to 25 [mm], preferably about 20 [mm]. An axial length of the fixing roller 230 is a length that sufficiently corresponds to the maximum paper width (for example, 300 [mm]) that can be conveyed.

The fixing roller 230 is rotationally driven (moved) in a direction R of FIG. 3, that is, clockwise, for example, when power is transmitted from the first drive motor 250. A circumferential velocity (first velocity) of the fixing roller 230 can be set to (for example, about 300 to 700 [mm/s]). The fixing belt 220 rotates (moves) following the rotation of the fixing roller 230. Accordingly, the fixing roller 230 is indirectly heated by the heater 211 via the fixing belt 220.

The first drive motor 250 may be a brushless motor, for example. In this case, the control unit 500 controls a current flowing through a winding of each phase by controlling the magnitude and direction of a voltage applied to each of the U, V, and W phases of the first drive motor 250. For the current control of the first drive motor 250, for example, an inverter circuit and a PWM (Pulse Width Modulation) circuit can be used.

The pressure roller 240 functions as a pressure member, and includes, from the inside, a metal core 241 made of cylindrical metal, an elastic layer 242 made of a material such as silicone rubber or foamed silicone rubber and formed on the surface of the metal core 241, and a releasing layer (not illustrated). In the present embodiment, an outer diameter of the pressure roller 240 is set to be the same as the outer diameter of the fixing roller 230 at the room temperature before heating by the heater 211. In addition, an axial length of the pressure roller 240 and the releasing layer can be configured to be the same as those of the fixing roller 230. On the other hand, in the present embodiment, a thickness of the elastic layer 242 of the pressure roller 240 is smaller than that of the elastic layer 232 of the fixing roller 230, and can be formed to be, for example, about 2 to 5 [mm], and preferably about 3 [mm].

In this manner, the thickness of the elastic layer 232 of the fixing roller 230 is formed to be larger than the thickness of the elastic layer 242 of the pressure roller 240, and thus, the fixing roller 230 becomes relatively softer than the pressure roller 240 at a fixing nip portion N. When the pressure roller 240 is pressed against the fixing roller 230 via the fixing belt 220 with a predetermined fixing load, surface shapes of the fixing roller 230 and the fixing belt 220 are concave while the relatively hard pressure roller 240 exhibits a small deformation amount so that a surface shape thereof is convex. As a result, the surface of the fixing belt 220 easily comes into close contact with minute irregularities of paper, and the paper is discharged along a curvature of the pressure roller 240 due to the convex shape of the surface of the pressure roller 240, and thus, there is an advantage that the paper is easily separated from the fixing belt 220.

In addition, the pressure roller 240 can be rotationally driven (moved) in a direction opposite to the direction R, that is, counterclockwise when power is transferred from the second drive motor 260. A circumferential velocity (second velocity) of the pressure roller 240 can be set to (for example, about 300 to 700 [mm/s]). The second drive motor 260 may be, for example, a brushless motor similarly to the first drive motor 250. The fixing belt 220 and the pressure roller 240 form the fixing nip portion N.

The entry guide 270 guides entry of the paper conveyed from the image forming unit 130 into the fixing nip portion N. The entry guide 270 is arranged toward the fixing nip portion N from a conveyance path from the image forming unit 130 to the fixing unit 200.

<Gloss Control>

Figures 4, 5:
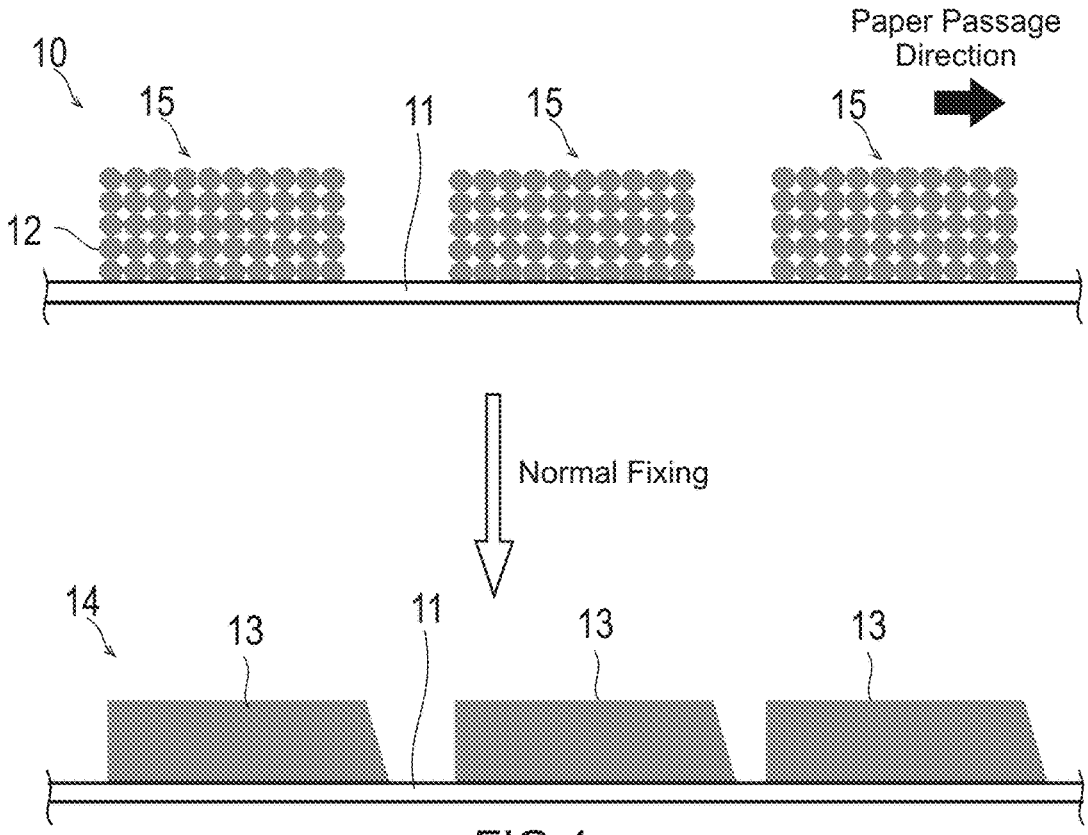
FIG. 4 is a conceptual view for describing a cross-sectional shape of a toner image and a cross-sectional shape of a dot after normal fixing.
FIG. 5 is a schematic view illustrating a relationship between the magnitude of a shearing force applied to a toner particle of the toner image and the deformation of the toner particle.
Figure 6:
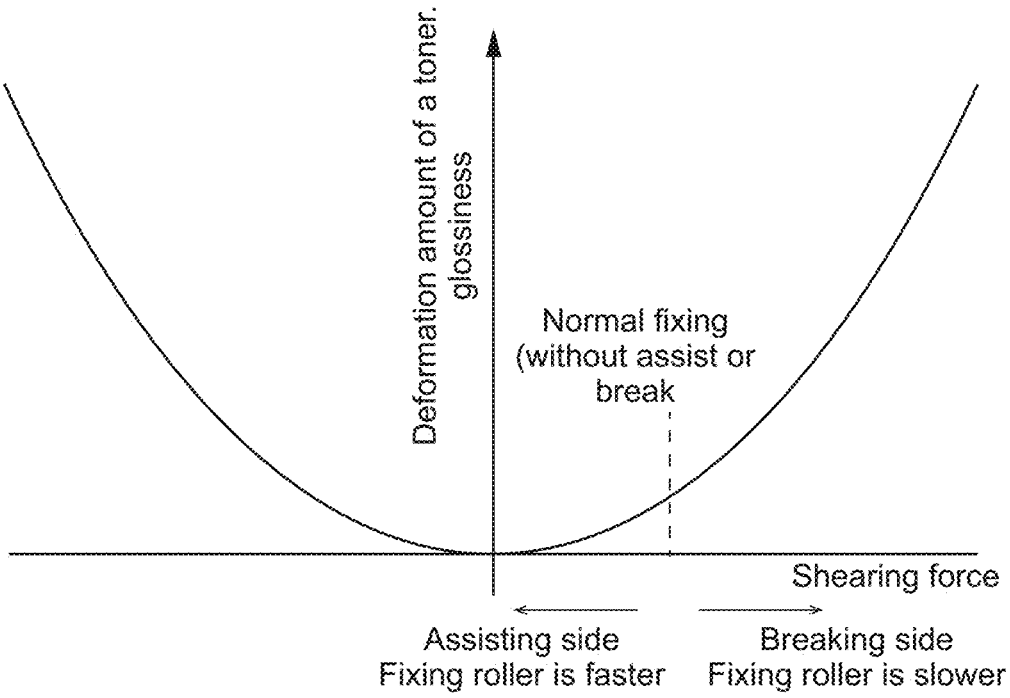
FIG. 6 is a graph illustrating a relationship between the shearing force applied to the toner particle of the toner image, a deformation amount and glossiness of the toner particle.

A method for controlling the gloss of an image to be fixed on paper by the fixing unit 200 will be described with reference to FIGS. 4 to 6. FIG. 4 is a conceptual view for describing a cross-sectional shape of a toner image and a cross-sectional shape of a dot after normal fixing; In addition, FIG. 5 is a schematic view illustrating a relationship between the magnitude of a shearing force applied to a toner particle of the toner image and the deformation of the toner particle. Note that a shape of the toner particle in FIG. 5 is conceptually illustrated when the toner particle is viewed from above. In addition, FIG. 6 is a graph illustrating a relationship between the shearing force applied to the toner particle of the toner image, a deformation amount and glossiness of the toner particle. In FIG. 6, the horizontal axis of the graph represents the shearing force, and the vertical axis represents a deformation amount or glossiness of a toner.

As illustrated in FIG. 4, a toner image 10 includes a large number of toner particles 12 stacked on paper 11 in a plurality of layers. These toner particles 12 are deformed so as to be stretched by being heated and pressurized when being fixed in the fixing unit 200, and are fused to the surface of the paper 11. As a result, a dot image 14 is constituted by a large number of dots 13 fused to the paper 11. The dots 13 after fixing correspond to dots of the toner image 10 before fixing, that is, a stacked body (hereinafter simply referred to as a "toner layer 15") of the toner particles 12.

In the present embodiment, the gloss of an image to be fixed on the paper 11 is controlled by adjusting the magnitude of the shearing force to be applied to the toner layer 15. More specifically, the control unit 500 controls the first drive motor 250 and the second drive motor 260 to set a velocity difference between the circumferential velocity of the fixing belt 220 and the circumferential velocity of the pressure roller 240, thereby applying the shearing force to the toner layer 15.

As illustrated in (A) in FIG. 5, normally, an unfixed toner particle of the toner image have a spherical shape, and a diameter thereof is, for example, about 6 [μm].

The toner image is fixed on the paper 11 at the fixing nip portion N of the fixing unit 200. During normal fixing, the control unit 500 drives the second drive motor 260 without driving the first drive motor 250 and drives the fixing roller 230 by the rotation of the pressure roller 240. Therefore, the circumferential velocity of the fixing belt 220 becomes slightly slower than the circumferential velocity of the pressure roller 240, and a small shearing force is generated between the surface of the fixing belt 220 and the surface of the pressure roller 240. As a result, the small shearing force is applied to the toner layer 15 of the toner image 10, the toner particles 12 contained in the toner layer 15 are deformed and fixed so as to be slightly stretched in a direction of the shearing force indicated by an arrow (see (C) of FIG. 5). In this case, the toner particle 12 after fixing have an elliptical shape, and the major diameter thereof can be about 19 [μm] and the minor diameter thereof can be about 15 [μm].

As illustrated in FIG. 6, the circumferential velocity of the pressure roller 240 is faster than that in the case of normal fixing, and a large shear is generated between the surface of the fixing belt 220 and the surface of the pressure roller 240 when the circumferential velocity of the fixing belt 220 further becomes relatively slower than the circumferential velocity of the pressure roller 240. Therefore, since the shearing force applied to the toner layer 15 of the toner image 10 becomes large, the deformation amount of the toner particles 12 increases, and the toner particles 12 are stretched so that the glossiness of the toner image increases. In this specification, making the circumferential velocity of the fixing belt 220 slower than the circumferential velocity of the pressure roller 240 is referred to as "brake". That is, when the brake is applied, a shearing force is generated, and the glossiness of the dot image 14 becomes high (see (D) in FIG. 5).

On the other hand, as the circumferential velocity of the fixing belt 220 is made faster than the circumferential velocity of the pressure roller 240 (also referred to as "assist" in this specification), the shearing force applied to the toner layer 15 of the toner image 10 decreases or no shearing force is applied. In such a case, the deformation amount of the toner particle 12 becomes small, and the glossiness of the dot image 14 becomes low. When no shearing force is applied, the toner particles are uniformly stretched and fixed in any direction, the toner particle 12 after fixing has a circular shape (see (B) in FIG. 5), and a diameter thereof can be about 15 [μm].

Furthermore, when the circumferential velocity of the fixing belt 220 is made much faster than the circumferential velocity of the pressure roller 240 (also referred to as "over-assist" in this specification), the shearing force is applied to the toner layer 15 in the opposite direction to the brake and the toner particles are deformed in the opposite direction, and thus, the glossiness of the dot image 14 becomes high (see (D) in FIG. 5). The major diameter of the toner particle after fixing can be about 26 [μm], and the minor diameter thereof can be about 15 [μm].

<Relationship Between Gloss Control and Image Quality>

The inventor of the present invention has conducted experiments on the normal fixing and the fixing in the case of gloss control and evaluated experimental results, and as a result, has found that there is a relationship between the gloss control and the image quality of a dot image after fixing.

Figure 7A:
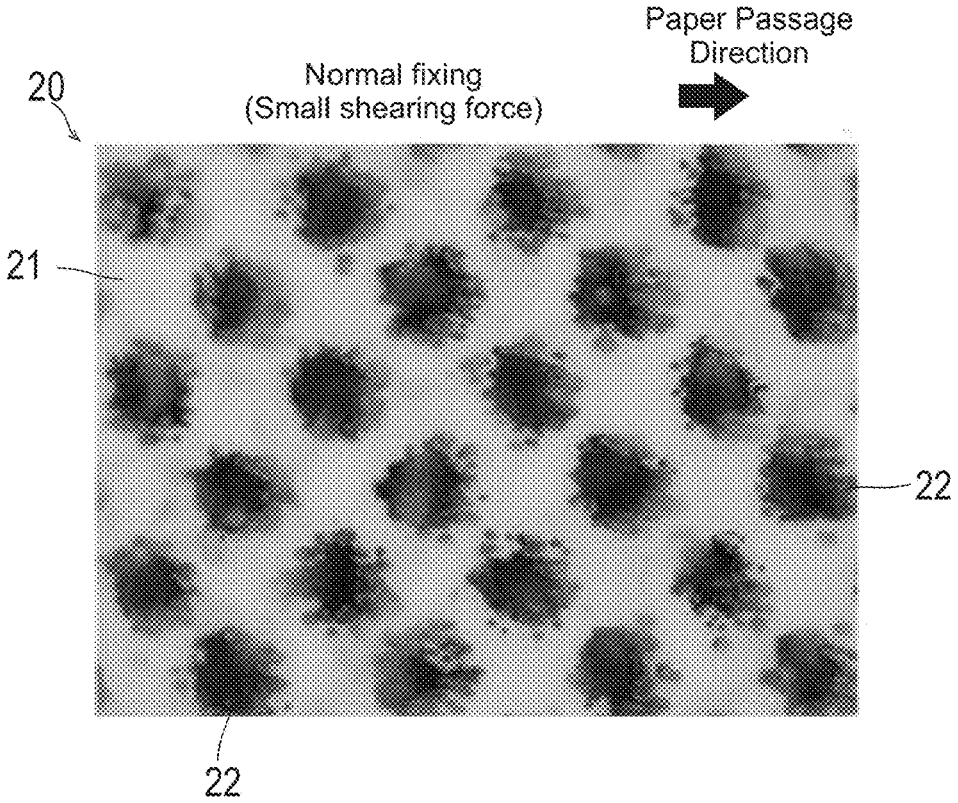
FIG. 7A is a photograph of a top view of a dot image on paper when normal fixing is performed.
Figure 7B:
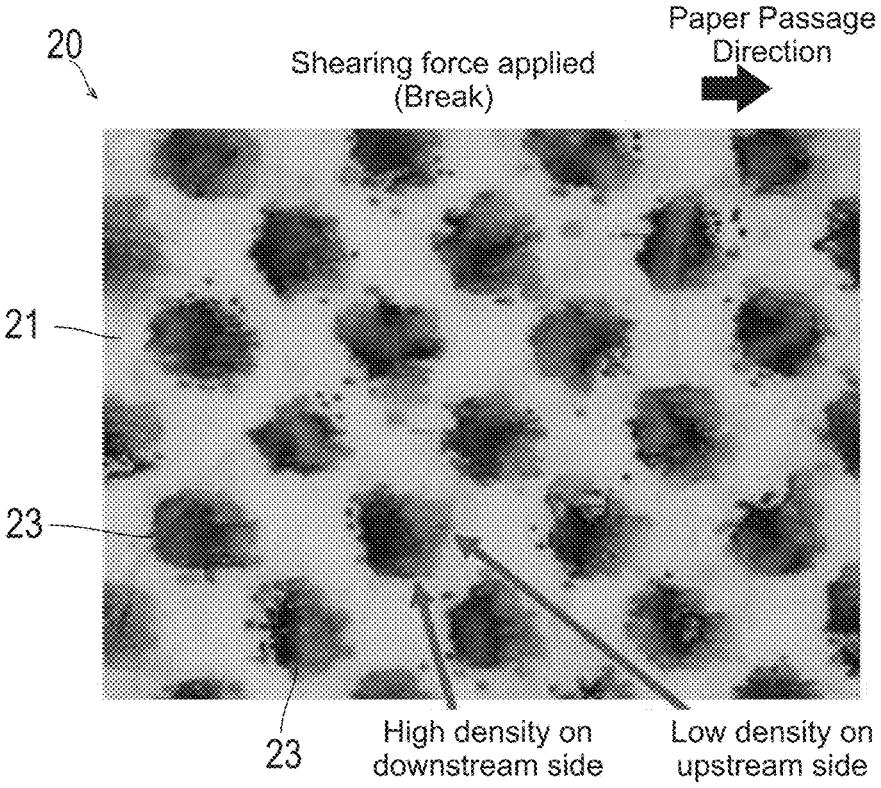
FIG. 7B is a photograph of a top view of a dot image on paper when a toner is fixed by applying a shearing force (brake)
Figure 8:
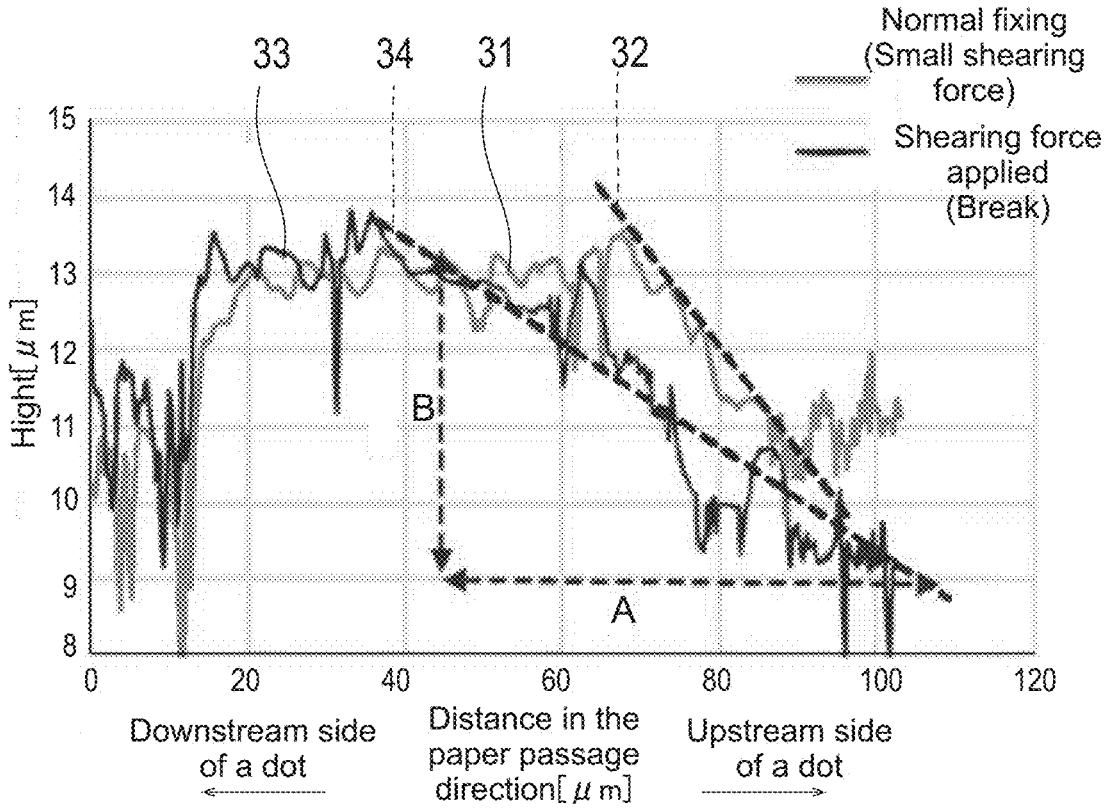
FIG. 8 is a graph illustrating a result of measurement of a height of a dot with respect to a distance of the dot in a paper passage direction.

FIG. 7A is a photograph of a top view of a dot image on paper in the case of normal fixing, and FIG. 7B is a photograph of a top view of a dot image on paper when a toner layer has been fixed by applying a shearing force (brake). Note that FIGS. 7A and 7B are all photographs captured at a magnification of about 500 times using a laser microscope (manufactured by Keyence Corporation). In addition, FIG. 8 is a graph which illustrates a result of measuring a height of a dot with respect to a distance of the dot in a paper passage direction in the case where no shearing force is applied to the toner layer and the case where the shearing force (brake) is applied. In FIG. 8, the horizontal axis of the graph represents the distance [μm] in the paper passage direction within the dot, and the vertical axis represents the dot height [μm].

As illustrated in FIG. 7A, there is no shearing force applied to the toner layer 15 or a small shearing force is applied in the case of normal fixing, and thus, the density of each portion in each of dots 22 of a dot image 20 on paper 21 is approximately the same.

On the other hand, when the toner layer is fixed by applying the shearing force (brake) as illustrated in FIG. 7B, a dark part and a light part can be generated in each portion of each of dots 23 on the paper 21. In this case, the circumferential velocity of the fixing belt is slower than the circumferential velocity of the pressure roller at the time of fixing, and thus, an upstream density of a dot is low and a downstream density thereof is high.

In addition, even in the case where a shearing force (assist) is applied to the toner layer for fixing, a part having a high density and a part having a low density can occur in each portion of each dot on the paper 21 although not illustrated. In this case, the circumferential velocity of the fixing belt is faster than the circumferential velocity of the pressure roller at the time of fixing, and thus, an upstream density of a dot is high and a downstream density thereof is low.

When the normal fixing is performed as illustrated in FIG. 8, a dot height (gray solid line 31) is about 13 [μm] and is almost constant in a range where the distance in the paper passage direction is about 20 to 70 [μm]. In addition, the dot height decreases from the center to an upstream end as substantially indicated by an inclined line 32 in a range where the distance in the paper passage direction is about 70 to 100 [μm].

On the other hand, when the toner layer is fixed by applying the shearing force (brake), a dot height (black solid line 33) is approximately 13 [μm] and is almost constant in a range where the distance in the paper passage direction is about 20 to 40 [μm]. In addition, the dot height decreases from the downstream side to an upstream end as substantially indicated by an inclined line 34 in a range where the distance in the paper passage direction is about 40 to 100 [μm].

In this manner, when the normal fixing is performed, a dot thickness has many flat portions from the upstream side to the downstream side, and the density thereof is maintained substantially uniform. On the other hand, when the toner layer is fixed by applying the shearing force (brake), a dot thickness is thin on the upstream side and thick on the downstream side so that unevenness occurs in the density since the dot thickness is different between the upstream side and the downstream side.

In addition, when the toner layer is fixed by applying a shearing force (over-assist), a dot thickness is thick on the upstream side and thin on the downstream side although not illustrated, which is opposite to the case of brake. Since the dot thickness is different between the upstream side and the downstream side of the dot even in the case of over-assist, unevenness occurs in the density.

<Density Unevenness>

Figure 9:
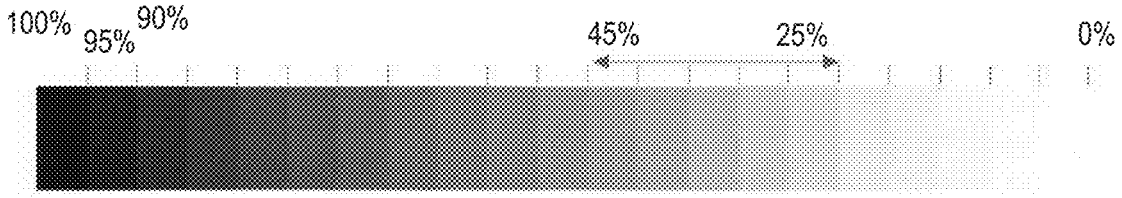
FIG. 9 is a schematic view illustrating a relationship between a dot image pattern and density unevenness.
Figure 10:
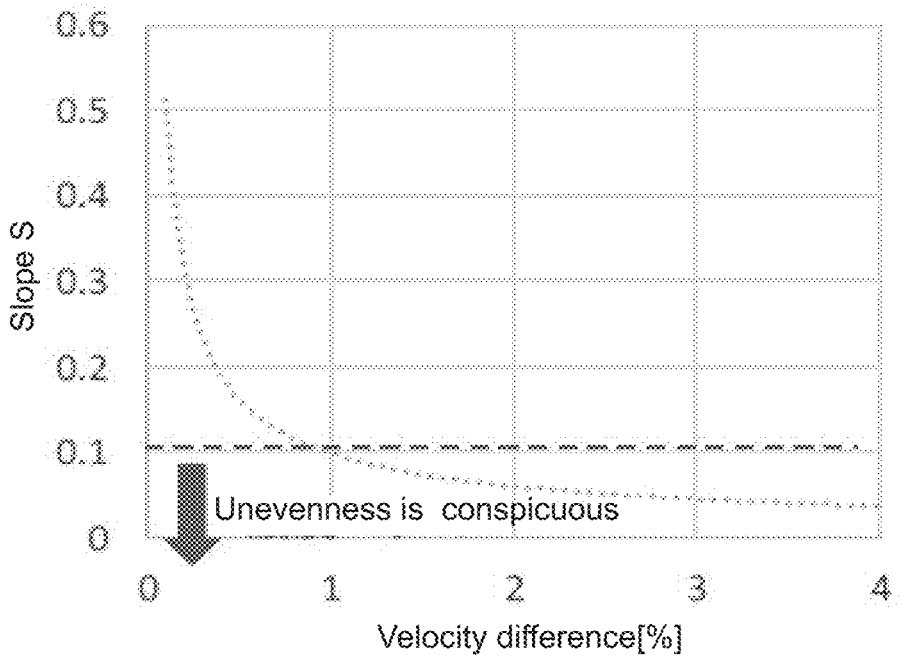
FIG. 10 is a graph illustrating a relationship between a dot slope and a velocity difference.

FIG. 9 is a schematic view illustrating a relationship between a dot image pattern and density unevenness, and FIG. 10 is a graph illustrating a relationship between a dot slope and a velocity difference [%]. The horizontal axis of FIG. 10 represents the velocity difference [%] between the circumferential velocity of the fixing belt and the circumferential velocity of the pressure roller, and the vertical axis represents the dot slope.

Whether density unevenness is visually conspicuous depends on an individual difference on the image-viewing side, but it is possible to set a determination criterion to some extent on how much density unevenness is conspicuous based on determination results of density unevenness by many users and past determination results.

For example, whether density unevenness is visually conspicuous depends on a dot image pattern. In FIG. 9, where an image density is high (for example, 95 to 100%), that is, an image pattern is a solid image having a large area, dots are formed so as to be dense in a portion and thus, density unevenness is often relatively inconspicuous (unnoticeable).

On the other hand, when a dot image is a halftone with a halftone dot pattern, dots becomes sparse as compared to the solid image, and thus, density unevenness is sometimes conspicuous depending on an image density. For example, when the image density is 25 to 45 [%], the deterioration of image quality caused by the density unevenness is particularly conspicuous.

In addition, a change of a cross-sectional shape of a dot after fixing also becomes large as the velocity difference between the circumferential velocity of the fixing belt and the circumferential velocity of the pressure roller (hereinafter also simply referred to as the "velocity difference") is increased and a shearing force applied to a toner layer by the brake or over-assist is increased. Therefore, the density unevenness becomes more conspicuous. The degree of deformation of the cross-sectional shape of the dot is defined by a slope S=B/A (see FIG. 8). The slope S is equal to the dot slope (inclined line 34). As a result of the investigation on the density unevenness, a result that the density unevenness was conspicuous was obtained when the slope S was 0.1 or less as a determination criterion. Note that the slope S can be acquired by a known method. For example, the slope S can be acquired by calculating an approximate straight line based on a distribution of data of the black solid line 33 illustrated in FIG. 8.

As illustrated in FIG. 10, the dot slope S is 0.1 or less when the velocity difference is 1% or more.

<Measurement of Velocity Difference>

Figure 11A:
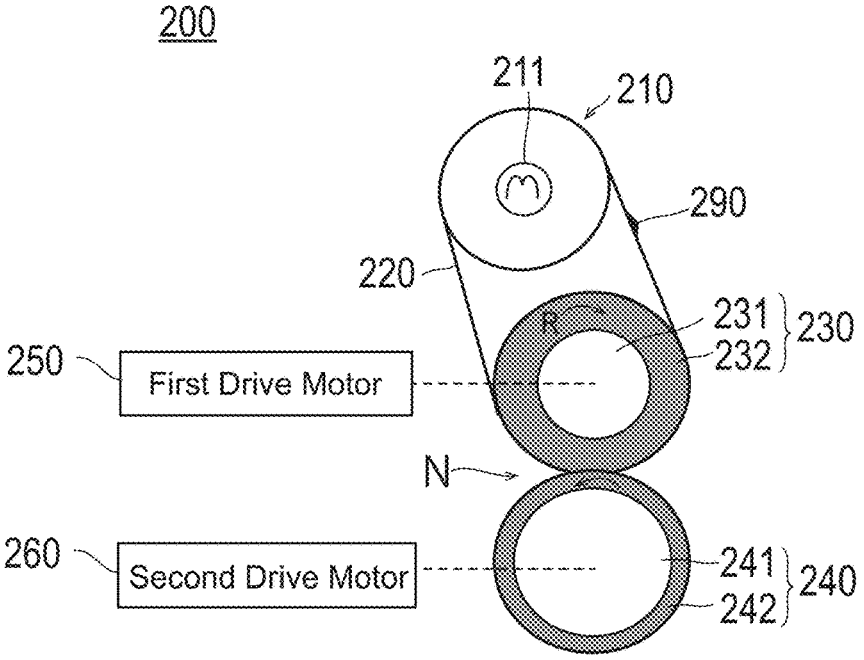
FIG. 11A is a schematic view for describing a marking applied on a fixing belt.
Figure 11B:
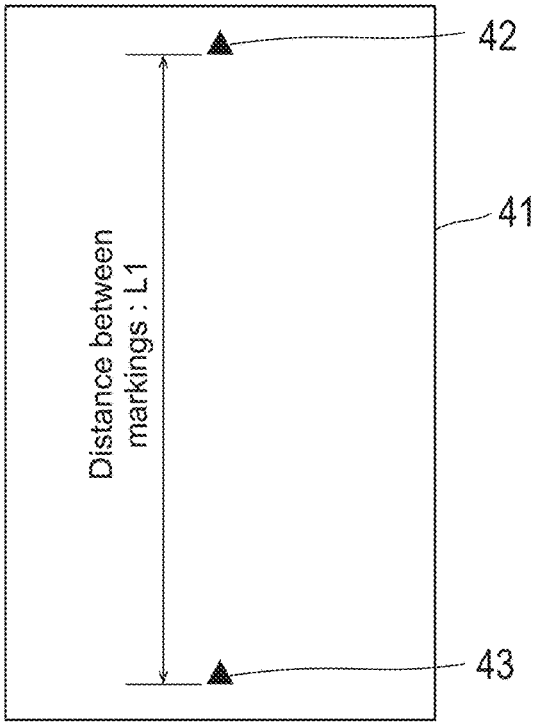
FIG. 11B is a schematic view for describing a marking trace attached to paper after fixing.

FIG. 11A is a schematic view for describing a marking 290 attached on the fixing belt 220, and FIG. 11B is a schematic view for describing a marking trace attached to paper after fixing.

As illustrated in FIG. 11A, the marking 290 is provided on the fixing belt 220 to fix an image longer than a circumferential length of the fixing belt 220. As a result, traces 42 and 43 of the marking 290 attached to the fixing belt 220 appear on the fixed image on paper 41 as illustrated in FIG. 11B. A distance between markings on this fixed image is measured and is defined as L1. The distance L1 corresponds to a distance traveled by the fixing belt 220 in one round.

As described above, the surface shapes of the fixing roller 230 and the fixing belt 220 are concave since the surface of the pressure roller 240 is relatively harder than the surfaces of the fixing roller 230 and the fixing belt 220. For this reason, the fixing belt 220 travels longer at the fixing nip portion N by the amount of the concave shape, and as a result, the circumferential velocity of the fixing belt 220 becomes faster at the fixing nip portion N. When the circumferential length of the fixing belt 220 is L2, a velocity difference ΔV [%] is expressed by $\Delta V=(L1-L2)/L2$.

<Configuration for Suppression of Image Quality Deterioration>

Figure 12A:
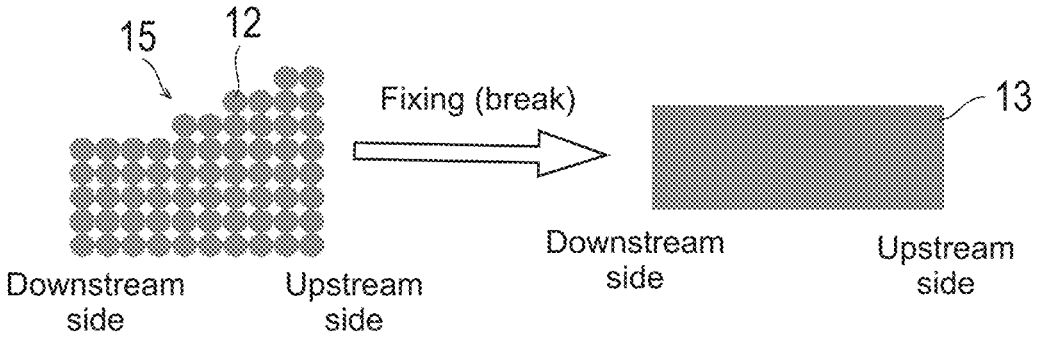
FIG. 12A is a conceptual view for describing a cross-sectional shape of a toner image formed by an image forming unit of the present embodiment and a cross-sectional shape of a dot fixed by applying a shearing force to a toner.
Figure 12B:
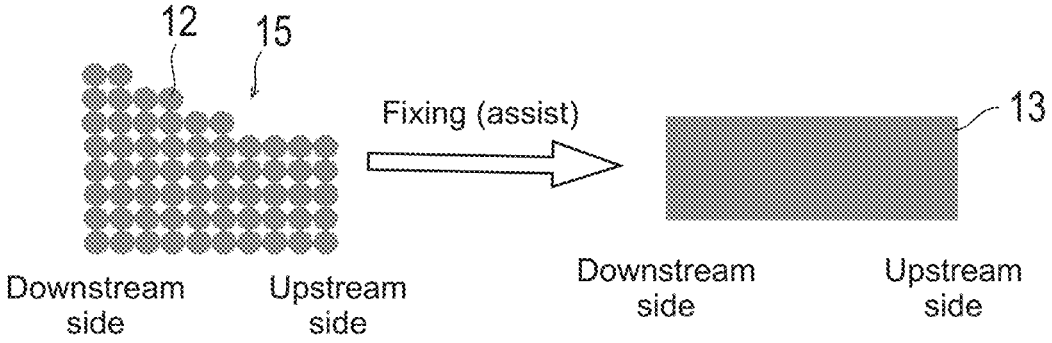
FIG. 12B is a conceptual view for describing a cross-sectional shape of a toner image formed by the image forming unit of the present embodiment and a cross-sectional shape of a dot fixed by applying a shearing force to a toner.
Figure 13A:
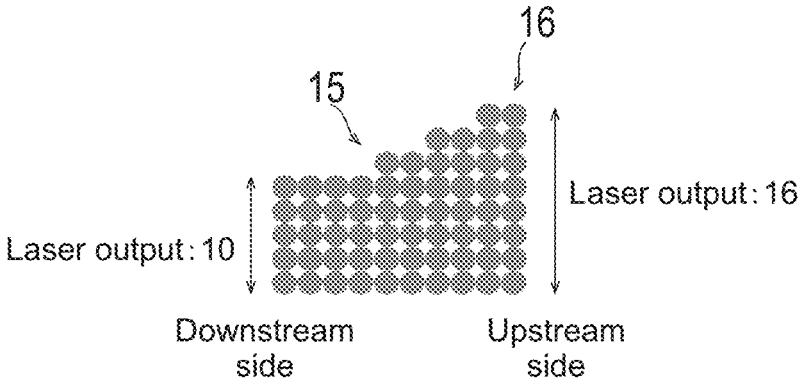
FIG. 13A is a conceptual view for describing an example in which a laser output of the image forming unit is changed as means for changing the density of the toner image.
Figure 13B:
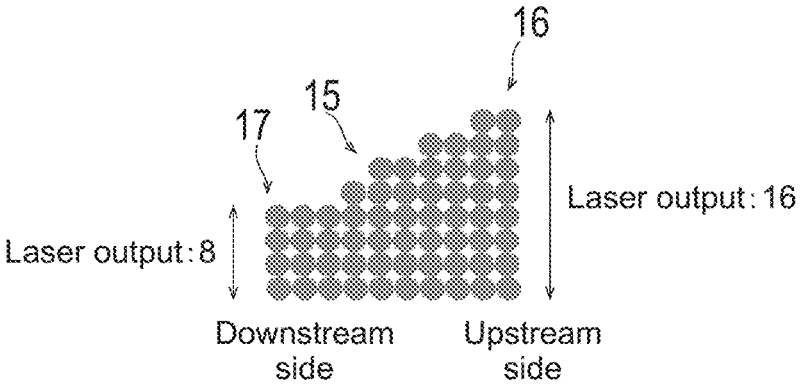
FIG. 13B is a conceptual view for describing another example in which the laser output of the image forming unit is changed as means for changing the density of the toner image.
Figure 14:
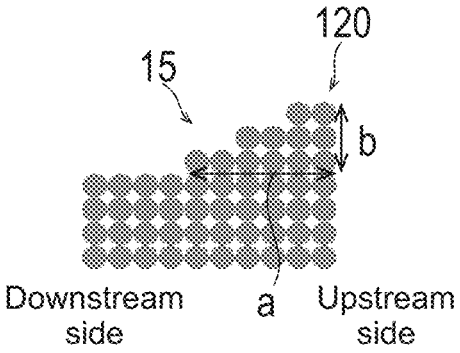
FIG. 14 is a conceptual view for describing a change amount in the density change of the toner image.

FIGS. 12A and 12B are conceptual views for describing a cross-sectional shape of a toner image 10 formed by the image forming unit 130 of the present embodiment and a cross-sectional shape of the dot 13 fixed by applying a shearing force to the toner layer 15. FIG. 12A illustrates the case where fixing is performed with the brake, and FIG. 12B is the case where fixing is performed with the assist. In addition, FIGS. 13A and 13B are conceptual views for describing an example and another example, respectively, in which a laser output of the image forming unit 130 is changed as means for changing the density of the toner image 10. In addition, FIG. 14 is a conceptual view for describing a change amount in the density change of the toner image 10.

In the present embodiment, the toner image 10 is formed so as to interpolate, in advance, for the deformation of the cross-sectional shape of the toner layer 15 caused by the shearing force applied to the toner layer 15 of the toner image 10 accompanying the gloss control. When the circumferential velocity of the fixing belt 220 and the circumferential velocity of the pressure roller 240 are different at the fixing nip portion N, the control unit 500 determines the amount of toner to be attached to the paper 11 such that the distribution of the toner amount is different in each dot before fixing. More specifically, the control is performed as follows.

When fixing is performed with the brake as illustrated in FIG. 12A, the control unit 500, for each of the dots 13 of the dot image 14 after fixing, sets the distribution of the toner amount in each dot before fixing to be different between the upstream side and the downstream side such that the density on the upstream side becomes the same as the density on the downstream side.

As described above, when the number of layers of toner particles stacked in the toner image is formed to be uniform in the dot and fixing is performed with the brake, the dot thickness in the dot image after fixing is thicker on the downstream side and gradually becomes thinner toward the upstream end. Therefore, the control unit 500 controls the amount of toner to be attached to the paper 11 by the image forming unit 130 such that the number of layers of the toner particles 12 is gradually increased from the downstream side to the upstream side of the toner layer 15 at the time of forming the toner image 10 in the case of fixing with the brake. As a result, the toner amount on the upstream side of the dot of the toner image 10 (that is, the toner layer 15) becomes larger than the toner amount on the downstream side, and the density on the upstream side of each of the dots 13 of the dot image 14 becomes substantially the same as the density on the downstream side after fixing. As a result, the density from the upstream side to the downstream side of each of the dots 13 of the dot image 14 becomes substantially constant.

In addition, the control unit 500 controls the amount of toner attached to the paper 11 such that the downstream density of each of the dots 13 of the dot image 14 after fixing is substantially the same as the upstream density even in the case of fixing with the over-assist as illustrated in FIG. 12B.

As described above, when the number of layers of toner particles stacked in the toner image is formed to be uniform in the dot and fixing is performed with the over-assist, the dot thickness in the dot image 14 after fixing is thicker on the upstream side and gradually becomes thinner toward the downstream end. Therefore, the control unit 500 controls the amount of toner to be attached to the paper 11 by the image forming unit 130 such that the number of layers of the toner particles 12 is gradually increased from the upstream side to the downstream side of the dot at the time of forming the toner image. As a result, the toner amount on the downstream side of the dot of the toner image 10 (that is, the toner layer 15) becomes larger than the toner amount on the upstream side, and the density on the downstream side of each of the dots 13 of the dot image 14 becomes substantially the same as the density on the upstream side after fixing. As a result, the density from the upstream side to the downstream side of each of the dots 13 of the dot image 14 becomes substantially constant.

The toner amount is changed by adjusting the laser output of the optical writing unit 3 of the image forming unit 130, for example. The control unit 500 controls an exposure condition of the optical writing unit 3, for example, controls the magnitude of the laser output to determine the amount of toner to be attached to the paper 11.

As illustrated in FIG. 13A, the control unit 500 outputs a control signal to the image forming unit 130 such that the laser output increases from the downstream side toward the upstream side so as to increase the number of layers from the downstream side to the upstream side of the dot when fixing is performed with the brake. For example, when a normal laser output is set to ten regarding the magnitude of the laser output, the control unit 500 can increase the laser output on the upstream side stepwise from ten with respect to ten of the downstream side and set an upstream end 16 to a maximum value of sixteen.

In addition, for example, the control unit 500 can also set a downstream end 17 to eight, which is smaller than that at the time of normal fixing, regarding the magnitude of the laser output, and increase the laser output on the upstream side stepwise from eight and set the upstream end 16 to a maximum value of sixteen as illustrated in FIG. 13B.

In addition, the control unit 500 interpolates the deformation of the cross-sectional shape of each dot of the toner image 10 caused by the velocity difference between the circumferential velocity of the fixing belt 220 and the circumferential velocity of the pressure roller 240, and increases the amount of toner to be attached to the paper 11 such that the density from the upstream side to the downstream side of each dot after fixing is constant. Specifically, when a slope of a toner change amount is defined as T=b/a as illustrated in FIG. 14, the control unit 500 adjusts the magnitude of the laser output such that the slope T and the dot slope S are equal.

In addition, the deterioration in image quality caused by the density unevenness is particularly conspicuous when the image density is 25 to 45 [%] as described above, and thus, the control unit 500 may be configured to adjust the magnitude of the laser output when the image density of the dot image is 25 to 45 [%].

In addition, the density unevenness is conspicuous when the dot slope S is 0.1 or less as described above. In addition, the dot slope S is 0.1 or less when the velocity difference is 1% or more. Therefore, the control unit 500 may be configured to control the amount of toner attached to the paper 11 when the velocity difference is 1 [%] or more.

Furthermore, the change in the cross-sectional shape of the dots 13 after fixing also increases as the velocity difference increases and the shearing force applied to the toner by the brake or over-assist increases as described above, the density unevenness becomes more conspicuous. Therefore, the control unit 500 may be configured to control the amount of toner attached to the paper 11 in response to the velocity difference. For example, the toner change amount is increased when the velocity difference is large, and the toner change amount is decreased when the velocity is small.

The image forming apparatus 100 having the fixing unit 200 and the fixing unit 200 of the present embodiment described above has the following effects.

When the circumferential velocity of the fixing belt 220 and the circumferential velocity of the pressure roller 240 are different at the fixing nip portion N, the control unit 500 determines the amount of toner to be attached to the paper 11 such that the distribution of the toner amount is different in each dot before fixing. Therefore, the density unevenness can be prevented or suppressed even when the shearing force is applied between the toner image 10 on the paper 11 and the fixing belt 220 accompanying the gloss control.

As described above, the fixing unit 200 and the image forming apparatus 100 have been described in the embodiment. However, it is a matter of course that the present invention can be appropriately added, modified, and omitted by those skilled in the art within the scope of the technical idea.

For example, the case where the fixing unit 200 includes the fixing belt 220 has been illustrated in the above-described example, the present invention is not limited to such a case, and the present invention can be applied to a configuration in which the fixing unit 200 does not include the fixing belt 220. In such a case, the fixing roller 230 functions as a fixing member.

In the above example, the case where the control unit 500 controls the toner attachment amount has been described, but the present invention is not limited to such a case, and the fixing unit may include a control unit, and the control unit of the fixing unit may be configured to control the toner attachment amount.

Although embodiments of the present invention have been described and illustrated in detail, it is clearly understood that the same is by way of illustration and example only and not limitation, the scope of the present invention should be interpreted by terms of the appended claims.

The invention claimed is:

1. An image forming apparatus comprising:

an image former that forms a toner image constituted by a plurality of dots each containing a toner on a sheet;

a fixer that includes a fixing member moving at a first velocity and a pressure member forming a fixing nip portion with the fixing member and moving at a second velocity, and fixes the toner image on the sheet at the fixing nip portion; and a controller that determines a toner amount so as to make a toner amount distribution different in each of the dots before fixing when the first velocity and the second velocity at the fixing nip portion are different.

2. The image forming apparatus according to claim 1, wherein the controller makes a toner amount distribution different in the dot when the first velocity is slower than the second velocity.

3. The image forming apparatus according to claim 2, wherein the controller determines a toner amount such that an upstream toner amount is larger than a downstream toner amount in each of the dots.

4. The image forming apparatus according to claim 1, wherein the controller makes a toner amount distribution different in the dot when the first velocity is faster than the second velocity.

5. The image forming apparatus according to claim 4, wherein the controller determines a toner amount such that a downstream toner amount is larger than an upstream toner amount in each of the dots.

6. The image forming apparatus according to claim 1, wherein an image density of an image obtained by fixing the toner image on the sheet is 25 to 45%.

7. The image forming apparatus according to claim 1, wherein the controller makes a toner amount distribution different in the dot when a velocity difference between the first velocity and the second velocity is 1% or more.

8. The image forming apparatus according to claim 1, wherein the controller makes a toner amount distribution different in the dot in response to a velocity difference between the first velocity and the second velocity.

9. The image forming apparatus according to claim 1, wherein the controller increases a toner amount to be attached to the sheet such that a deformation of a cross-sectional shape of each of the dots of the toner image is interpolated and a density from an upstream side to a downstream side of each of the dots after fixing is constant.

10. The image forming apparatus according to claim 1, wherein the controller controls an exposure condition in the image former so as to make a toner amount distribution different in the dot.

* * * * *